United States Patent [19]

Saunders et al.

[11] Patent Number: 5,026,408

[45] Date of Patent: Jun. 25, 1991

[54] METHANE RECOVERY PROCESS FOR THE SEPARATION OF NITROGEN AND METHANE

[75] Inventors: John B. Saunders, Grand Island; James J. Maloney, Tonawanda, both of N.Y.

[73] Assignee: Union Carbide Industrial Gases Technology Corporation, Danbury, Conn.

[21] Appl. No.: 531,772

[22] Filed: Jun. 1, 1990

[51] Int. Cl.[5] ..... F25J 3/02

[52] U.S. Cl. ..... 62/24; 62/28; 62/42

[58] Field of Search ..... 62/24, 28, 42

[56] References Cited

U.S. PATENT DOCUMENTS

| | | | |
|---|---|---|---|
| 2,940,271 | 6/1960 | Jackson | 62/31 |
| 3,512,368 | 5/1970 | Harper | 62/21 |
| 3,740,962 | 6/1973 | Fan | 62/29 |
| 4,203,741 | 5/1980 | Bellinger et al. | 62/24 |
| 4,352,685 | 10/1982 | Swallow | 62/28 |
| 4,415,345 | 11/1983 | Swallow | 62/28 |
| 4,501,600 | 2/1985 | Pahade | 62/28 |
| 4,582,517 | 4/1986 | Burr et al. | 62/24 |
| 4,592,767 | 6/1986 | Pahade et al. | 62/31 |
| 4,664,686 | 5/1987 | Pahade et al. | 62/24 |
| 4,676,812 | 6/1987 | Kummann | 62/24 |
| 4,701,200 | 10/1987 | Fisher et al. | 62/27 |
| 4,711,651 | 12/1987 | Sharma et al. | 62/24 |
| 4,746,342 | 5/1988 | DeLong et al. | 62/42 |
| 4,846,863 | 7/1989 | Tomlinson et al. | 62/39 |
| 4,878,932 | 11/1989 | Pahade et al. | 62/24 |
| 4,966,612 | 10/1990 | Bauer | 62/28 |

*Primary Examiner*—Ronald C. Capossela
*Attorney, Agent, or Firm*—Stanley Ktorides

[57] ABSTRACT

A cryogenic nitrogen rejection unit with improved methane recovery wherein higher quality nitrogen reflux is generated by successive vapor partial condensations and the nitrogen is introduced into a separation column preferably in a cascade fashion.

16 Claims, 1 Drawing Sheet

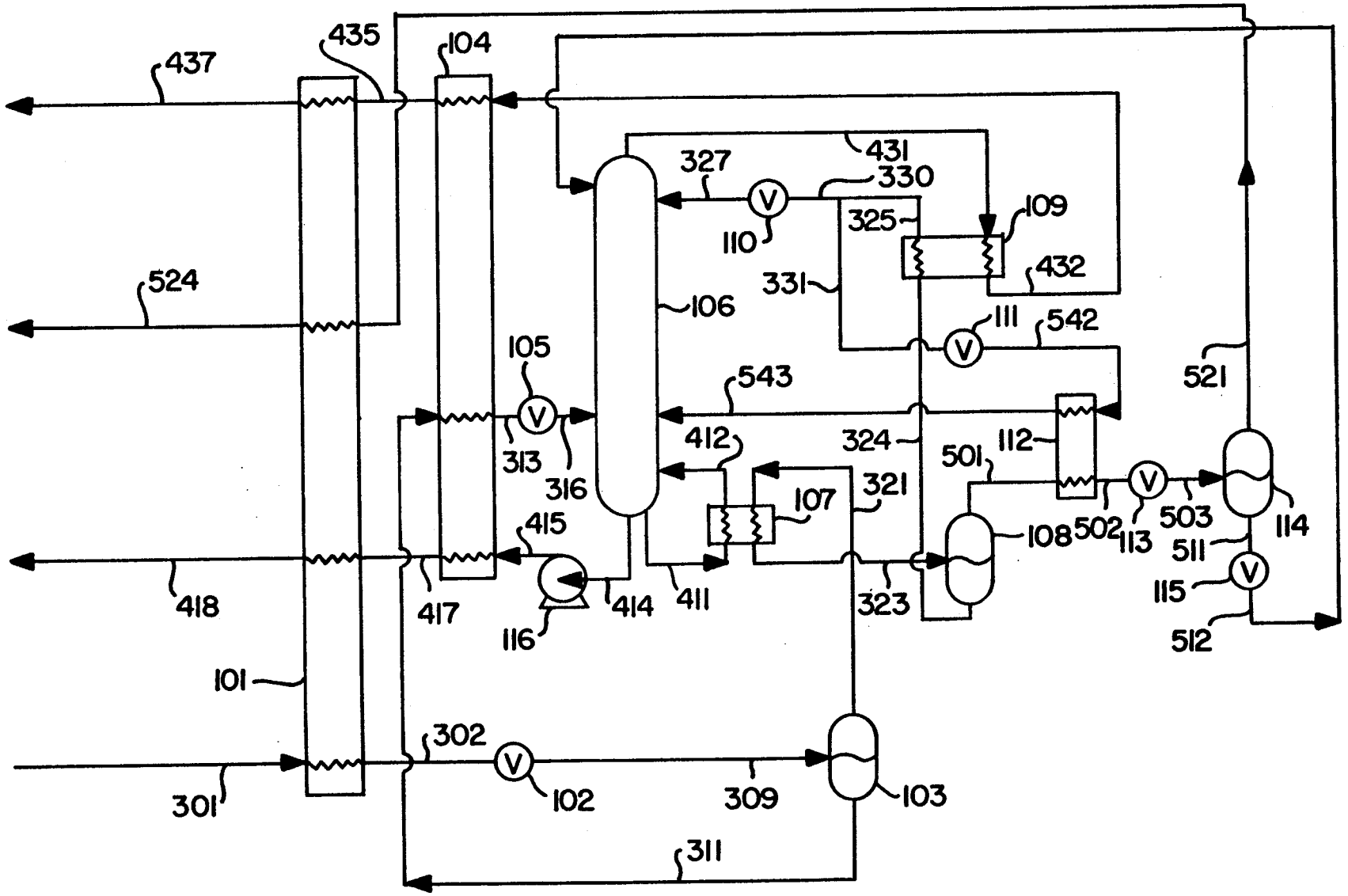
114
521
503
511
115
512
113
502
108
542
112
109
432
111
501
431
330
325
324
321
323
103
331
107
110
543
309
327
106
412
411
311
414
316
415
116
102
105
313
104
417
302
435
101
437
524
418
301

METHANE RECOVERY PROCESS FOR THE SEPARATION OF NITROGEN AND METHANE

TECHNICAL FIELD

This invention relates generally to the separation of nitrogen and methane by cryogenic rectification and is an improvement whereby methane recovery is increased when the feed contains one or more lower boiling or more volatile components.

BACKGROUND ART

One problem often encountered in the production of natural gas from underground reservoirs is nitrogen contamination. The nitrogen may be naturally occurring and/or may have been injected into the reservoir as part of an enhanced oil recovery (EOR) or enhanced gas recovery (EGR) operation. Natural gases which contain a significant amount of nitrogen may not be saleable, since they do not meet minimum heating value specifications and/or exceed maximum inert content requirements. As a result, the feed gas will generally undergo processing, wherein heavier components such as natural gas liquids are initially removed, and then the remaining stream containing primarily nitrogen and methane, and also possibly containing lower boiling or more volatile components such as helium, hydrogen and/or neon, is separated cryogenically. A common process for separation of nitrogen from natural gas employs a double column distillation cycle, similar to that used for fractionation of air into nitrogen and oxygen.

A recent significant advancement in such a process is described in Pahade et al. U.S. Pat. No. 4,878,932 wherein the feed is preseparated and the resulting liquid is partly vaporized to provide additional column vapor upflow resulting in improved methane recovery especially where the feed contains relatively low concentrations of nitrogen.

A problem with nitrogen-methane separation systems is the loss of some valuable methane with the nitrogen. This is especially the case where the feed additionally contains one or more lower boiling or more volatile components such as helium, hydrogen or neon and where recovery of such component(s) is desired. For example, when helium recovery is integrated into a cryogenic nitrogen-methane separation system, a portion of the nitrogen normally available as reflux is lost with the helium product. The reduction in the quantity and the quality of the nitrogen reflux results in an increased methane carryover thereby reducing the methane recovery.

Accordingly it is an object of this invention to provide an improved nitrogen-methane separation system.

It is another object of this invention to provide an improved nitrogen-methane separation system which can improve methane recovery where the feed additionally contains one or more lower boiling or more volatile components.

SUMMARY OF THE INVENTION

In general the present invention comprises a system whereby higher quality nitrogen reflux is provided to a separation column thereby reducing the loss of methane with nitrogen overhead and increasing methane recovery.

More particularly, one aspect of the present invention is:

A process of the separation of nitrogen and methane comprising:

(A) separating a feed comprising nitrogen and methane into nitrogen-enriched vapor and methane-enriched liquid;

(B) introducing the methane-enriched liquid into a column;

(C) partially condensing the nitrogen-enriched vapor to produce a first vapor and a first liquid, and introducing the first liquid into the column;

(D) partially condensing the first vapor to produce a second vapor and a second liquid, and introducing the second liquid into the column; and (E) separating the fluids passed into the column into nitrogen-richer and methane-richer components and recovering methane-richer component as product methane.

Another aspect of the present invention is:

Apparatus useful for the separation of nitrogen and methane comprising:

(A) means to separate a feed into feed vapor and feed liquid;

(B) a column and means to pass feed liquid into the column;

(C) means to partially condense feed vapor into a first vapor and a first liquid, and means to pass first liquid into the column;

(D) means to partially condense first vapor into a second vapor and a second liquid, and means to pass second liquid into the column; and (E) means to recover fluid from the column.

The term "column" is used herein to mean a distillation, rectification or fractionation column, i.e., a contacting column or zone wherein liquid and vapor phases are countercurrently contacted to effect separation of a fluid mixture, as for example, by contacting of the vapor and liquid phases on a series of vertically spaced trays or plates mounted within the column, or on packing elements, or a combination thereof. For an expanded discussion of fractionation columns see the Chemical Engineer's Handbook, Fifth Edition, edited by R. H. Perry and C. H. Chilton, McGraw-Hill Book Company, New York Section 13, "Distillation" B. D. Smith et al, page 13-3, *The Continuous Distillation Process.*

The term "double column", is used herein to mean high pressure column having its upper end in heat exchange relation with the lower end of a low pressure column. An expanded discussion of double columns appears in Ruheman, "The Separation of Gases" Oxford University Press, 1949, Chapter VII, Commercial Air Separation.

The terms "nitrogen rejection unit" and "NRU" are used herein to mean a facility wherein nitrogen and methane are separated by cryogenic rectification, comprising a column and the attendant interconnecting equipment such as liquid pumps, phase separators, piping, valves and heat exchangers.

The term "indirect heat exchange" is used herein to mean the bringing of two fluid streams into heat exchange relation without any physical contact or intermixing of the fluids with each other.

As used herein the term "subcooled" means a liquid which is at a temperature lower than that liquid's saturation temperature for the existing pressure.

As used herein the term "phase separator" means a device, such as a vessel with top and bottom outlets, used to separate a fluid mixture into its gas and liquid fractions.

As used herein the term "structured packing" means packing wherein individual members have specific orientation relative to each other and to the column axis.

BRIEF DESCRIPTION OF THE DRAWING

The sole FIGURE is a schematic flow diagram of one preferred embodiment of the improved NRU process and apparatus of this invention.

DETAILED DESCRIPTION

The invention will be described in detail with reference to the FIGURE.

Referring now to the FIGURE, natural gas feed 301 comprising nitrogen and methane is cooled and preferably partially condensed by indirect heat exchange with return streams by passage through heat exchanger 101. The concentrations of nitrogen and methane in the feed may vary considerably; the nitrogen concentration in the feed may be within the range of from 5 to 80 percent and the methane concentration in the feed may be within the range of from 20 to 95 percent. The feed may also contain some higher boiling hydrocarbons such as ethane although most of the higher boiling hydrocarbons will have been removed from the natural gas feed stream upstream of the NRU. The feed may also contain one or more lower boiling or more volatile components such as helium, hydrogen or neon.

Generally the pressure of feed stream 301 will be within the range of from 100 to 2000 pounds per square inch absolute (psia).

Resulting stream 302 is throttled across valve 102 and the resulting two phase stream 309 is introduced into phase separator 103 wherein it is separated into nitrogen-enriched feed vapor and methane-enriched feed liquid. Alternatively, stream 309 could be introduced into a column for separation into nitrogen-enriched feed vapor and methane-enriched feed liquid. Such a column could be the higher pressure column of a double column system.

Methane-enriched liquid is removed from separator 103 and passed as stream 311 through heat exchanger 104 wherein it is subcooled by indirect heat exchange with return streams. Subcooled stream 313 is flashed across valve 105 and resulting stream 316 is introduced into column 106 which is generally operating at a pressure within the range of from 15 to 200 psia.

Nitrogen-enriched vapor is removed from separator 103 and passed as stream 321 through heat exchanger 107 wherein it is partially condensed, preferably as illustrated in the FIGURE by indirect heat exchange with a liquid stream 411 from column 106. The resulting two phase stream 323 is passed into phase separator 108 wherein it is separated into a first vapor and a first liquid. The first liquid is richer in methane than is nitrogen-enriched vapor 321 which contains essentially all of the lower boiling, i.e. more volatile, component(s). First liquid 324 is passed from phase separator 108 and subcooled by passage through heat exchanger 109. Resulting stream 325 is divided into two portions. A first portion 330 is throttled across valve 110 and passed as stream 327 into column 106. Second portion 331 is throttled across valve 111, resulting stream 542 vaporized by indirect heat exchange through heat exchanger 112, and passed as stream 543 into column 106.

First vapor 501 is passed from phase separator 108 through heat exchanger 112 wherein it is partially condensed by indirect heat exchange with vaporizing first liquid second portion 542. In the case where the NRU feed additionally contains a lower boiling component such as helium, essentially all of such component or components is contained in stream 501. Resulting two phase stream 502 is flashed across valve 113 and resulting stream 503 is introduced into phase separator 114 wherein it is separated into second vapor 521 and second liquid 511.

Second liquid 511 has a higher nitrogen concentration than does first vapor 501 and also generally has a higher nitrogen concentration than does first liquid 327 introduced into column 106. Second liquid 511 is flashed across valve 115 and resulting stream 512 is introduced as reflux into column 106, preferably at a point higher than the introduction point of first liquid 327.

When feed 301 contains a significant amount of lower boiling component(s), second vapor 521 is passed from phase separator 114 through heat exchanger 101 and/or heat exchangers 104 and 112 and is recovered as a product stream 524. Alternatively, when the feed does not contain a significant amount of lower boiling component(s), stream 521 may be fed into column 106.

Within column 106 the feeds are separated by cryogenic distillation into nitrogen-richer and methane-richer components. The column internals may comprise trays or packing. If packing is used the packing may be structured packing. Nitrogen-richer component is removed as vapor stream 431 from column 106 and warmed by passage through heat exchanger 109 against subcooling first liquid. Resulting stream 432 is warmed by passage through heat exchanger 104, resulting stream 435 further warmed by passage through heat exchanger 101 and passed out of the NRU system as stream 437. Stream 437 may be released to the atmosphere, recovered, or injected into an oil or gas reservoir as part of a secondary recovery operation.

A liquid stream is removed from column 106 as stream 411 and vaporized against partially condensing nitrogen-enriched vapor 321 by passage through heat exchange 107. Resulting two phase stream 412 is returned to column 106. The vapor portion of stream 412 provides vapor upflow for column 106 and the liquid portion of stream 412 forms stream 414 comprising methane-richer component which is withdrawn from column 106. This stream is preferably pumped to a higher pressure by pump 116 and warmed by passage through heat exchanger 104. Resulting stream 417 is warmed and preferably vaporized by passage through heat exchanger 101 to produce stream 418 which is recovered as product methane or natural gas, generally having a methane concentration of about 90 to 100 percent.

By use of the method and apparatus of this invention wherein higher quality nitrogen-based liquid is generated and passed into the separation column as enhanced reflux in a cascade fashion, the recovery of methane is improved because less methane escapes recovery by passage out of the system with nitrogen overhead.

Table I lists the results of a computer simulation of the invention carried out with the embodiment illustrated in the FIGURE. The stream numbers correspond to those of the FIGURE. This example is presented for illustrative purposes and is not intended to be limiting.

TABLE I

| STREAM NO. | FLOW RATE (LB MOLE/HR) | TEMPERATURE (°K.) | PRESSURE (PSIA) | COMPOSITION (MOLE %) He | $N_2$ | $CH_4$ |
|---|---|---|---|---|---|---|
| 301 | 1000 | 163 | 435 | 1 | 33 | 66 |
| 327 | 117 | 87 | 30 | — | 67 | 33 |
| 437 | 297 | 150 | 30 | — | 99.5 | 0.5 |
| 512 | 39 | 83 | 30 | — | 94 | 6 |

For the feed conditions given, stream 327 contains 67 percent nitrogen while higher quality stream 512 contains 94 percent nitrogen. The use of stream 512 as higher quality reflux in a cascaded fashion permits a higher methane recovery in the column. The methane content in the nitrogen overhead is 0.5 percent, resulting in improved methane recovery over a conventional nitrogen-methane column separation wherein the methane content of the nitrogen overhead would be about 2.0 percent under comparable conditions. The invention also reduces the venting of hydrocarbons to atmosphere and results in a substantial reduction in capital costs over a conventional system which may require a double column.

Although the invention has been described in detail with reference to a certain specific embodiment, those skilled in the art will recognize that there are other embodiments of this invention within the spirit and scope of the claims.

What is claimed is:

1. A process for the separation of nitrogen and methane comprising:

(A) separating a feed comprising nitrogen and methane into nitrogen-enriched vapor and methane-enriched liquid;

(B) introducing the methane-enriched liquid into a column;

(C) partially condensing the nitrogen-enriched vapor to produce a first vapor and a first liquid, and introducing the first liquid into the column;

(D) partially condensing the first vapor to produce a second vapor and a second liquid, and introducing the second liquid into the column; and (E) separating the fluids passed into the column into nitrogen-richer and methane-richer components and recovering methane-richer component as product methane.

2. The process of claim 1 wherein the methane-enriched liquid is subcooled and flashed prior to introduction into the column.

3. The process of claim 1 wherein the first liquid is divided into two portions, a first portion is passed into the column, and a second portion is vaporized and then passed into the column.

4. The process of claim 3 wherein the first vapor is partially condensed by indirect heat exchange with the vaporizing second portion.

5. The process of claim 1 wherein the second liquid is introduced into the column at a point higher than the point at which the first liquid is introduced into the column.

6. The process of claim 1 wherein the feed additionally contains lower boiling component(s) and the second vapor is recovered as a product.

7. The process of claim 6 wherein the lower boiling component(s) comprise helium.

8. The process of claim 1 wherein the methane-richer component is pumped to a higher pressure and warmed by indirect heat exchange with feed prior to recovery.

9. The process of claim 1 wherein first liquid is subcooled by indirect heat exchange with nitrogen-richer component prior to introduction into the column.

10. Apparatus useful for the separation of nitrogen and methane comprising:

(A) means to separate a feed into feed vapor and feed liquid;

(B) a column and means to pass feed liquid into the column;

(C) means to partially condense feed vapor into a first vapor and a first liquid, and means to pass first liquid into the column;

(D) means to partially condense first vapor into a second vapor and a second liquid, and means to pass second liquid into the column; and (E) means to recover fluid from the column.

11. The apparatus of claim 10 wherein the means to separate the feed comprises a phase separator.

12. The apparatus of claim 10 wherein the means to separate the feed comprises a column.

13. The apparatus of claim 10 wherein the means to introduce second liquid into the column communicates with the column at a point higher than does the means to introduce first liquid into the column.

14. The apparatus of claim 10 wherein the means to partially condense the first vapor comprises a heat exchanger, further comprising conduit means to pass some first liquid through said heat exchanger and then into the column.

15. The apparatus of claim 10 further comprising means to recover second vapor.

16. The apparatus of claim 10 wherein the column has column internals comprising structured packing.

* * * * *